US007997244B2

(12) United States Patent
Ito et al.

(10) Patent No.: US 7,997,244 B2
(45) Date of Patent: Aug. 16, 2011

(54) INTERNAL COMBUSTION ENGINE

(75) Inventors: Kenji Ito, Wako (JP); Mitsuru Emori, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 138 days.

(21) Appl. No.: 12/566,666

(22) Filed: Sep. 25, 2009

(65) Prior Publication Data

US 2010/0108005 A1 May 6, 2010

(30) Foreign Application Priority Data

Nov. 4, 2008 (JP) ..... 2008-283315

(51) Int. Cl.
*F01M 1/06* (2006.01)

(52) U.S. Cl. ..... 123/90.33; 123/90.16; 123/90.31; 123/90.34

(58) Field of Classification Search ..... 123/90.16, 123/90.31, 90.33, 90.34; 475/7, 228
See application file for complete search history.

(56) References Cited

U.S. PATENT DOCUMENTS 7,121,238 B2 * 10/2006 Minami et al. ..... 123/90.15

FOREIGN PATENT DOCUMENTS

JP 61-23825 2/1986

* cited by examiner

*Primary Examiner* — Ching Chang
(74) *Attorney, Agent, or Firm* — Ditthavong Mori & Steiner, P.C.

(57) ABSTRACT

An internal combustion engine includes a control shaft, an actuator, and an oil accumulation portion. The control shaft is configured to vary a lift amount of an engine valve in accordance with a rotational position of the control shaft. The actuator is configured to drive the control shaft to make the lift amount of the engine valve to be a start lift amount before the engine is started. The actuator includes a worm wheel and a worm. The worm wheel is provided at the control shaft and is disposed in an engine body. The worm is disposed below the control shaft and engages with the worm wheel. The oil accumulation portion is provided at at least one of the control shaft and the worm wheel and is configured to drop oil onto the worm in accordance with the rotation of the control shaft when the engine is started.

6 Claims, 12 Drawing Sheets

INTERNAL COMBUSTION ENGINE

CROSS-REFERENCE TO RELATED APPLICATIONS

The present application claims priority under 35 U.S.C. §119 to Japanese Patent Application No. 2008-283315, filed Nov. 4, 2008. The contents of this application are incorporated herein by reference in their entirety.

BACKGROUND OF THE INVENTION

1. Field of the Invention

The present invention relates to an internal combustion engine.

2. Discussion of the Background

Such an internal combustion engine is already known due to Japanese Unexamined Patent Application Publication No. 61-23825.

In the internal combustion engine discussed in Japanese Unexamined Patent Application Publication No. 61-23825, when, for setting a lift amount of an engine valve to a start lift amount when the engine is started, a control shaft is rotationally driven by an actuator, the control shaft is rotationally driven without any supply of oil. Therefore, a gear mechanism constituting a portion of the actuator is not sufficiently lubricated. In addition, since oil is not sufficiently supplied even immediately after starting the engine, operating noise is generated at and wearing occurs in the gear mechanism.

SUMMARY OF THE INVENTION

According to one aspect of the present invention, an internal combustion engine includes a control shaft, an actuator, and an oil accumulation portion. The control shaft is configured to vary a lift amount of an engine valve in accordance with a rotational position of the control shaft. The actuator is configured to rotationally drive the control shaft according to an engine running state. The actuator is configured to drive the control shaft to make the lift amount of the engine valve to be a start lift amount before the engine is started. The actuator includes a worm wheel and a worm. The worm wheel is provided at the control shaft and is disposed in an engine body. The worm is disposed below the control shaft and engages with the worm wheel. The oil accumulation portion is provided at at least one of the control shaft and the worm wheel and is configured to drop oil onto the worm in accordance with the rotation of the control shaft when the engine is started.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENT

Figure 1:
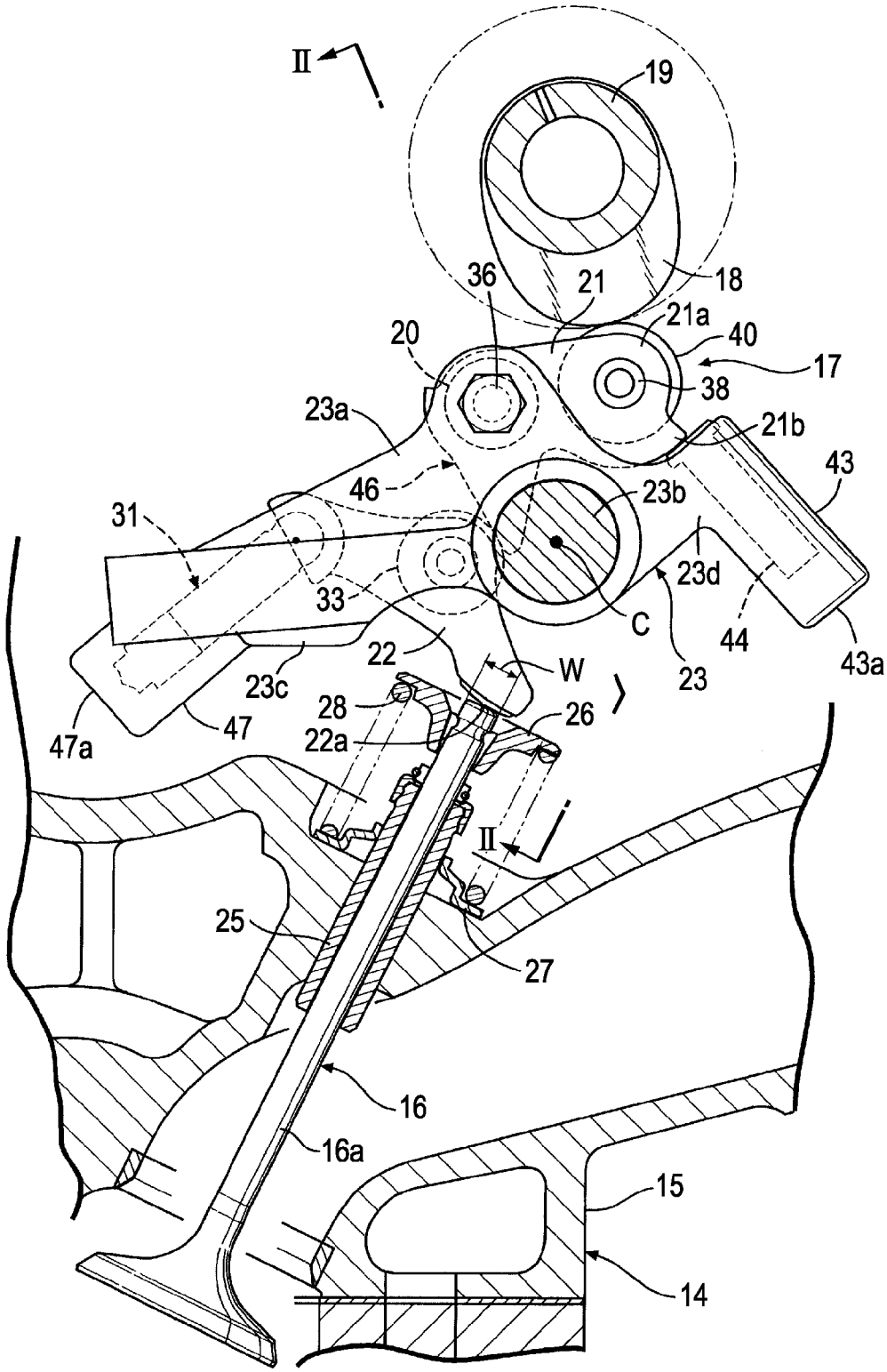
FIG. 1 is a vertical side sectional view of the main portion of an internal combustion engine according to an embodiment of the present invention.

Embodiments will now be described with reference to the accompanying drawings, wherein like reference numerals designate corresponding or identical elements throughout the various drawings. An embodiment of the present invention will hereunder be described with reference to the attached drawings.

Figure 2:
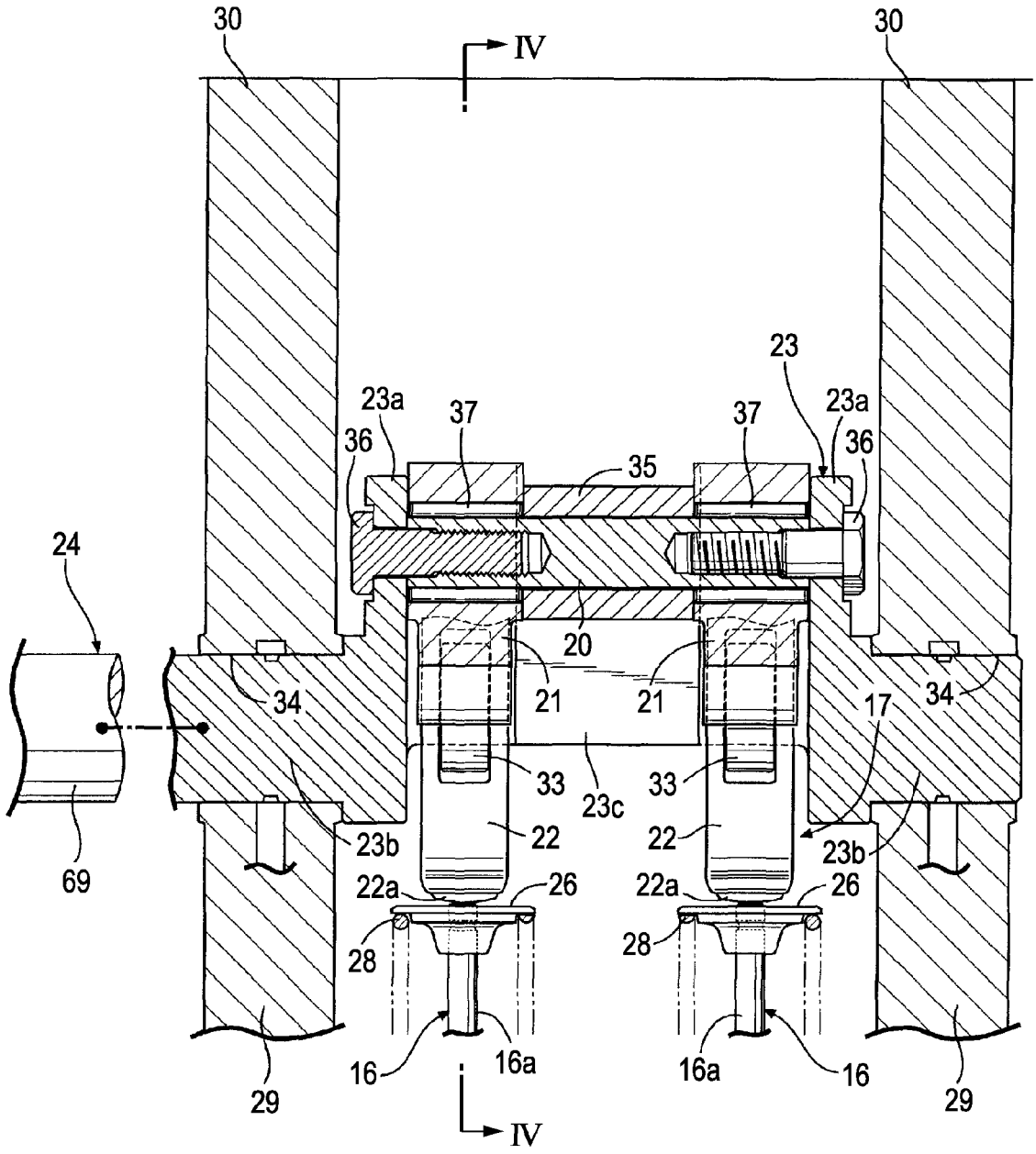
FIG. 2 is a sectional view taken along line II-II in FIG. 1.
Figure 3:
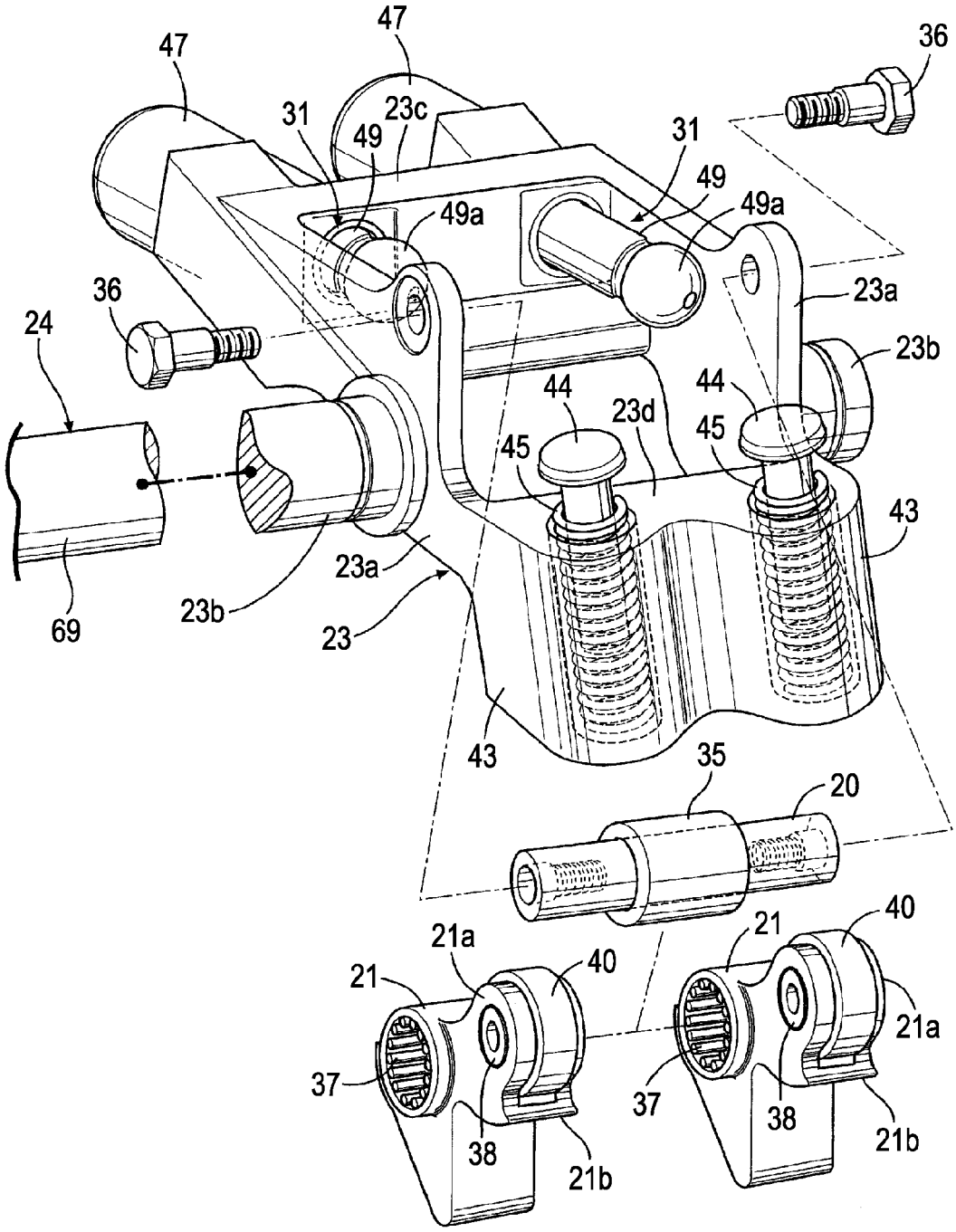
FIG. 3 is an exploded perspective view of the main portion of a variable valve operating device.
Figure 4:
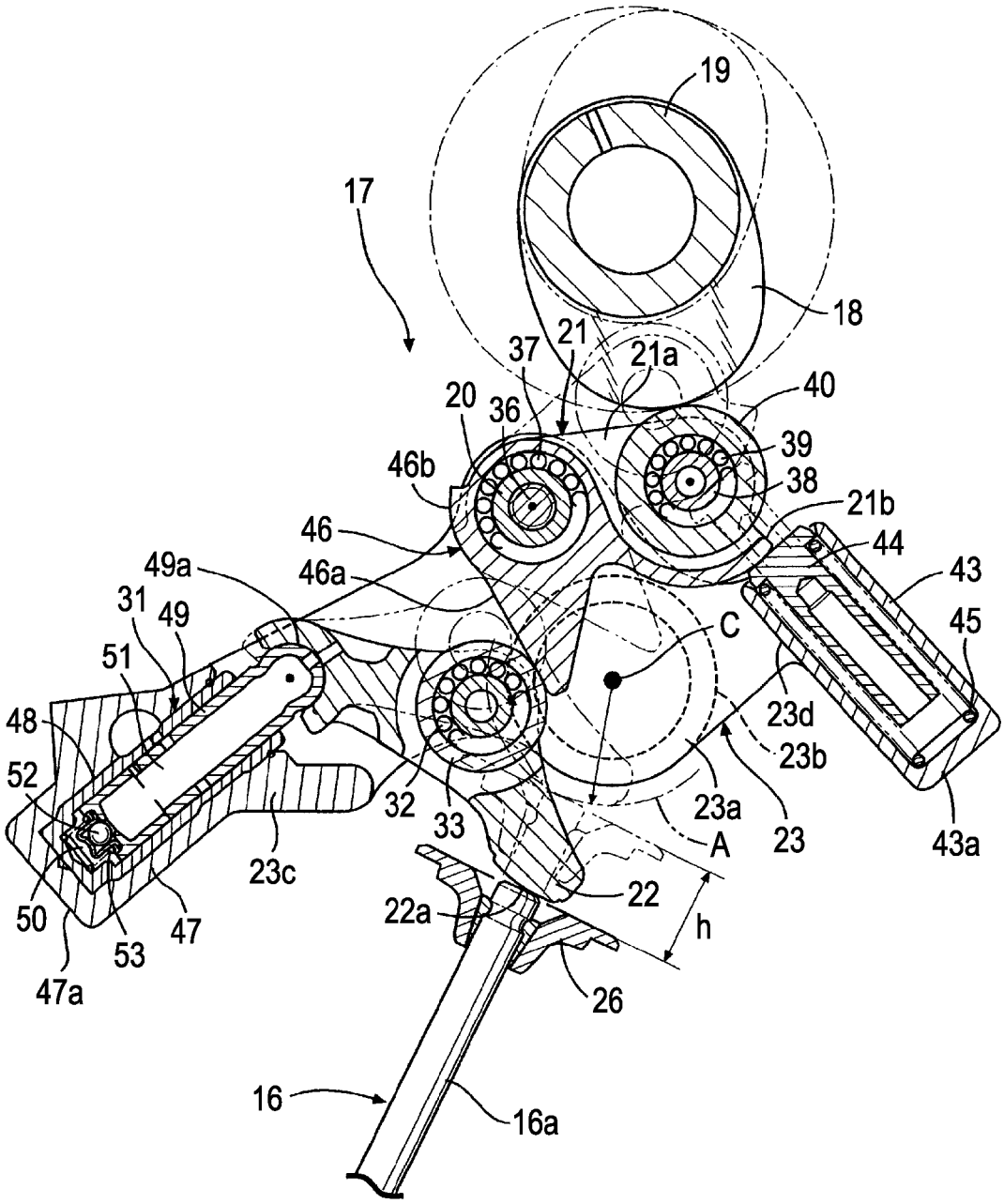
FIG. 4 is a sectional view taken along line IV-IV in FIG. 2 with a lift amount being high.
Figure 5:
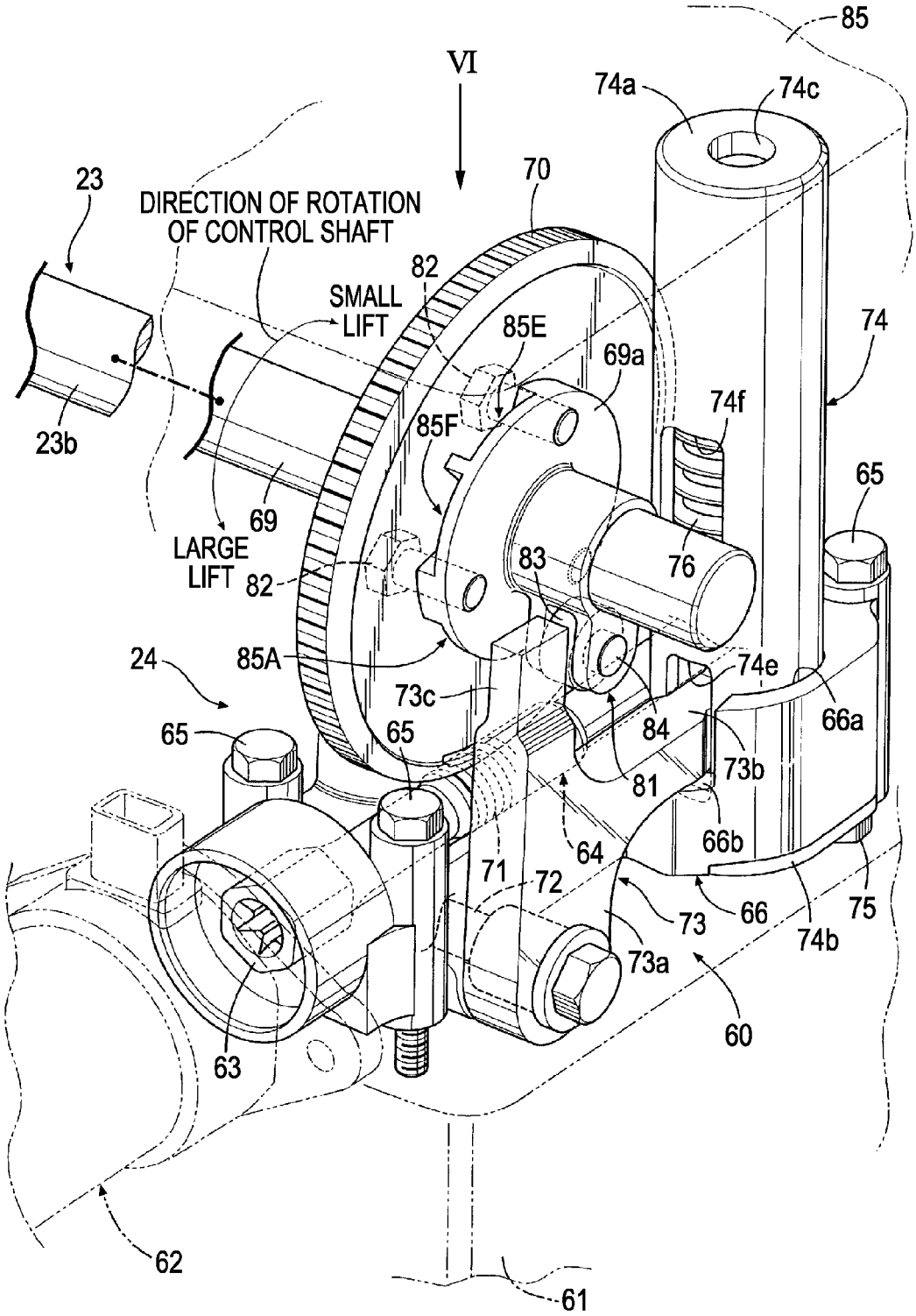
FIG. 5 is a perspective view of an actuator and a default mechanism.
Figure 6:
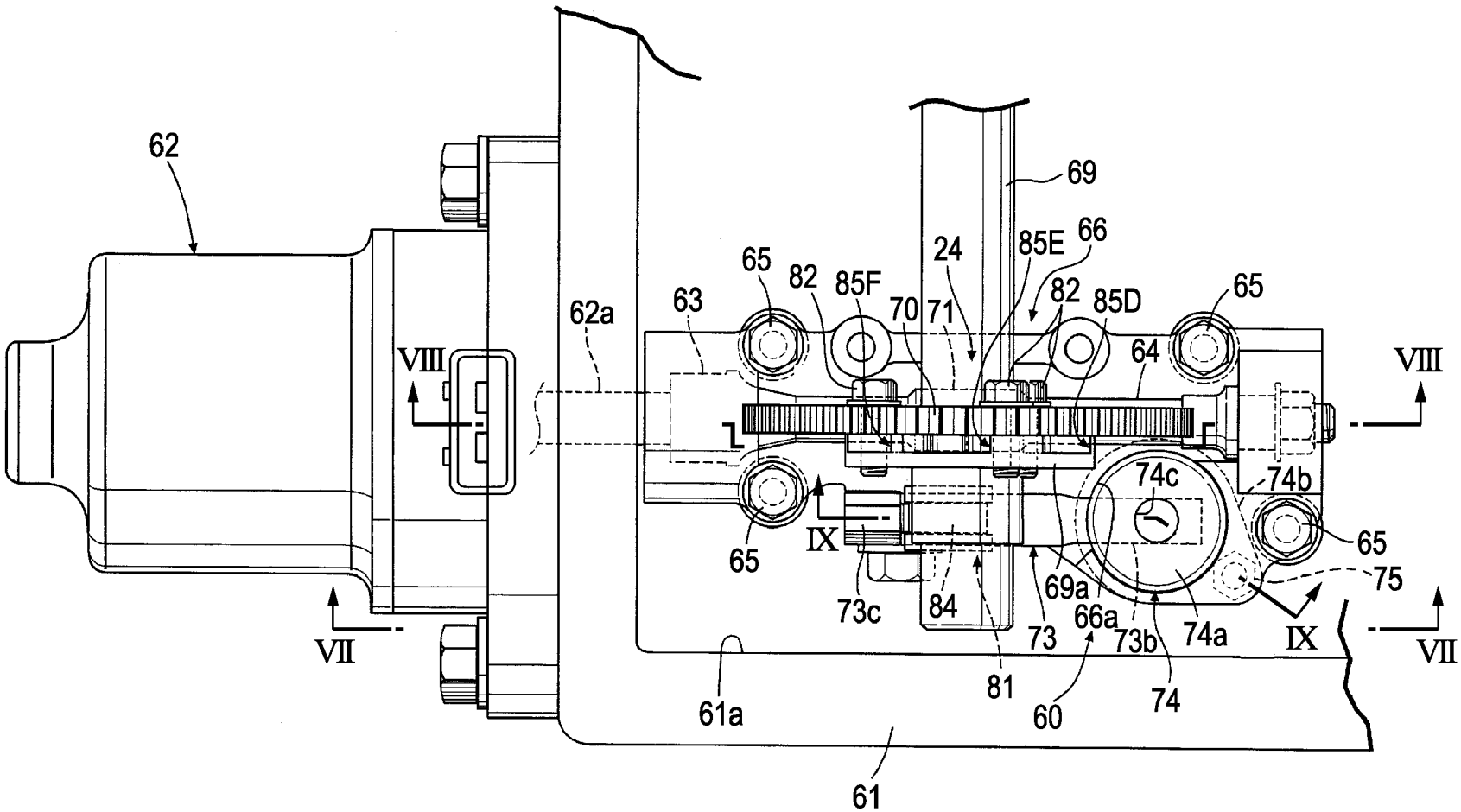
FIG. 6 is a view taken along arrow VI in FIG. 5.
Figure 7:
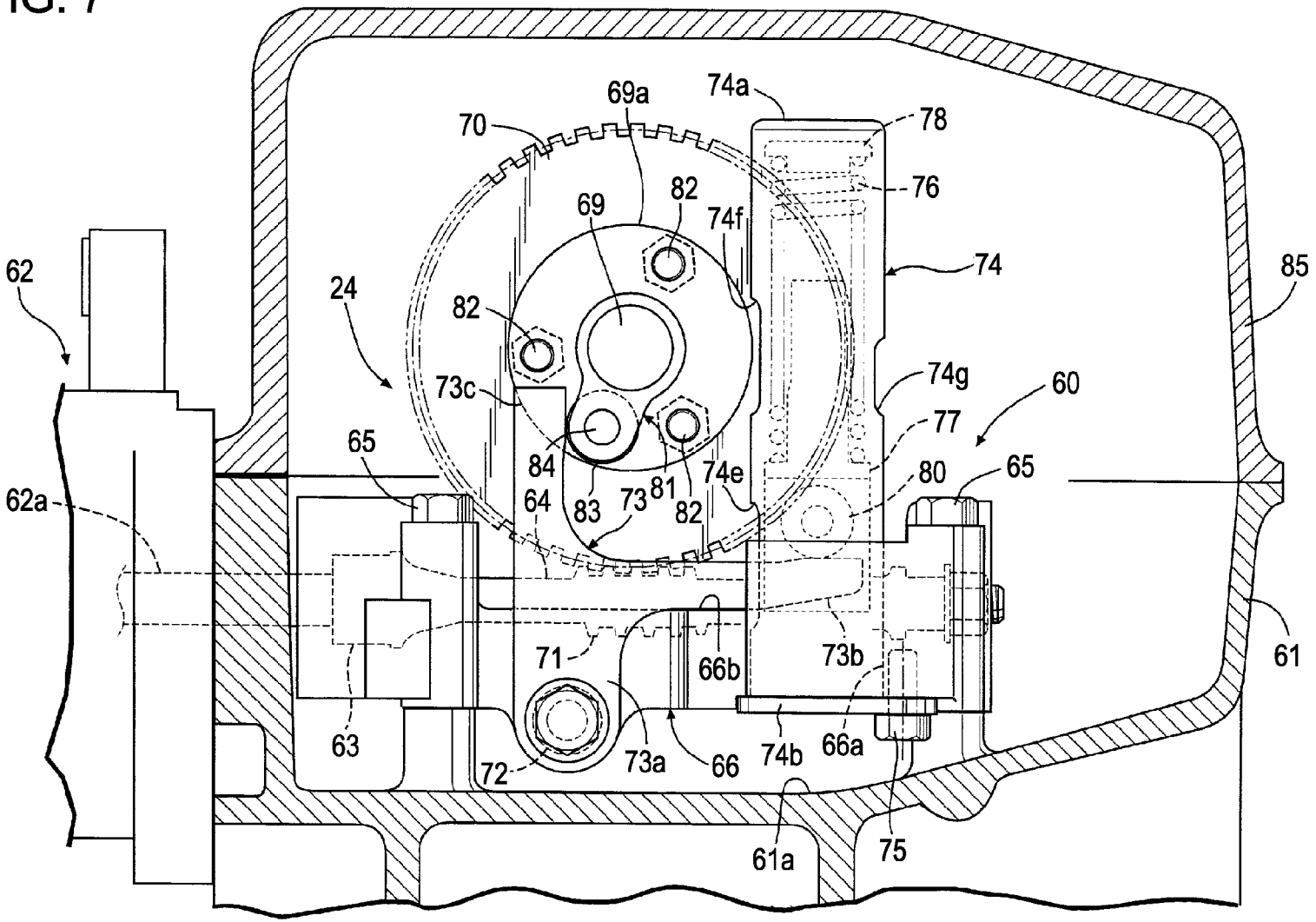
FIG. 7 is a sectional view taken along line VII-VII in FIG. 6.
Figure 8:
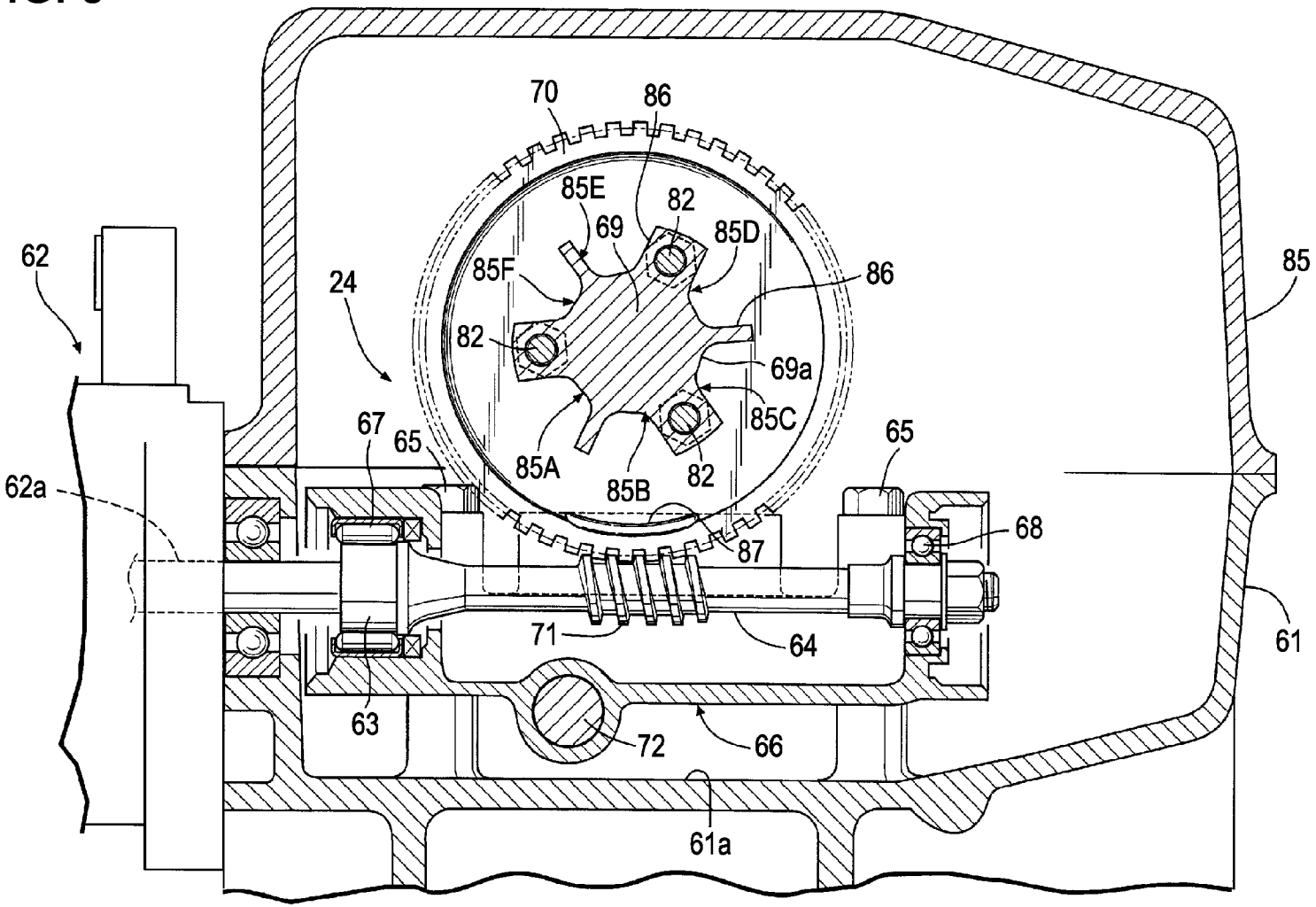
FIG. 8 is a sectional view taken along line VIII-VIII in FIG. 6.
Figure 9:
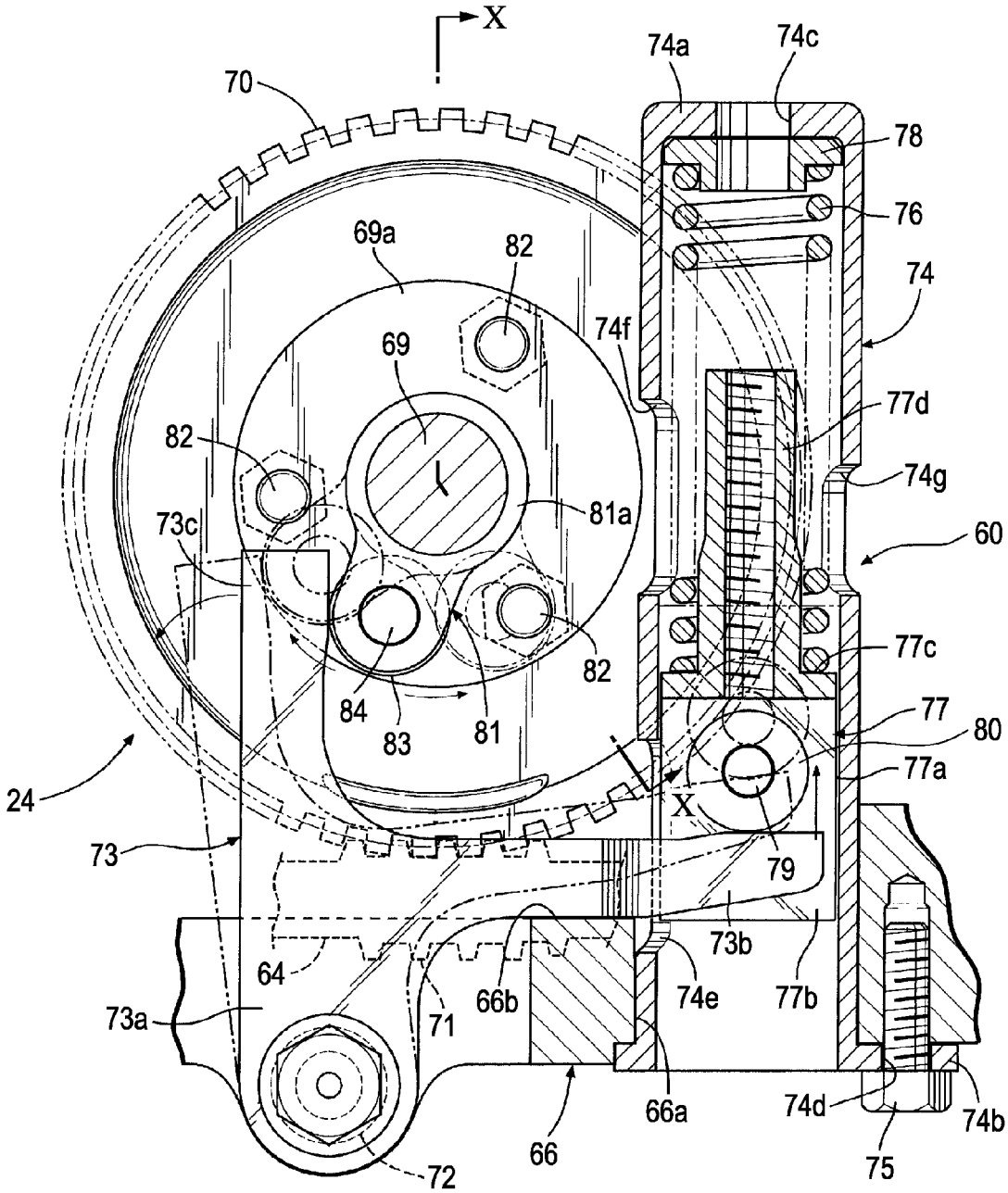
FIG. 9 is a sectional view taken along line IX-IX in FIG. 6.
Figure 10:
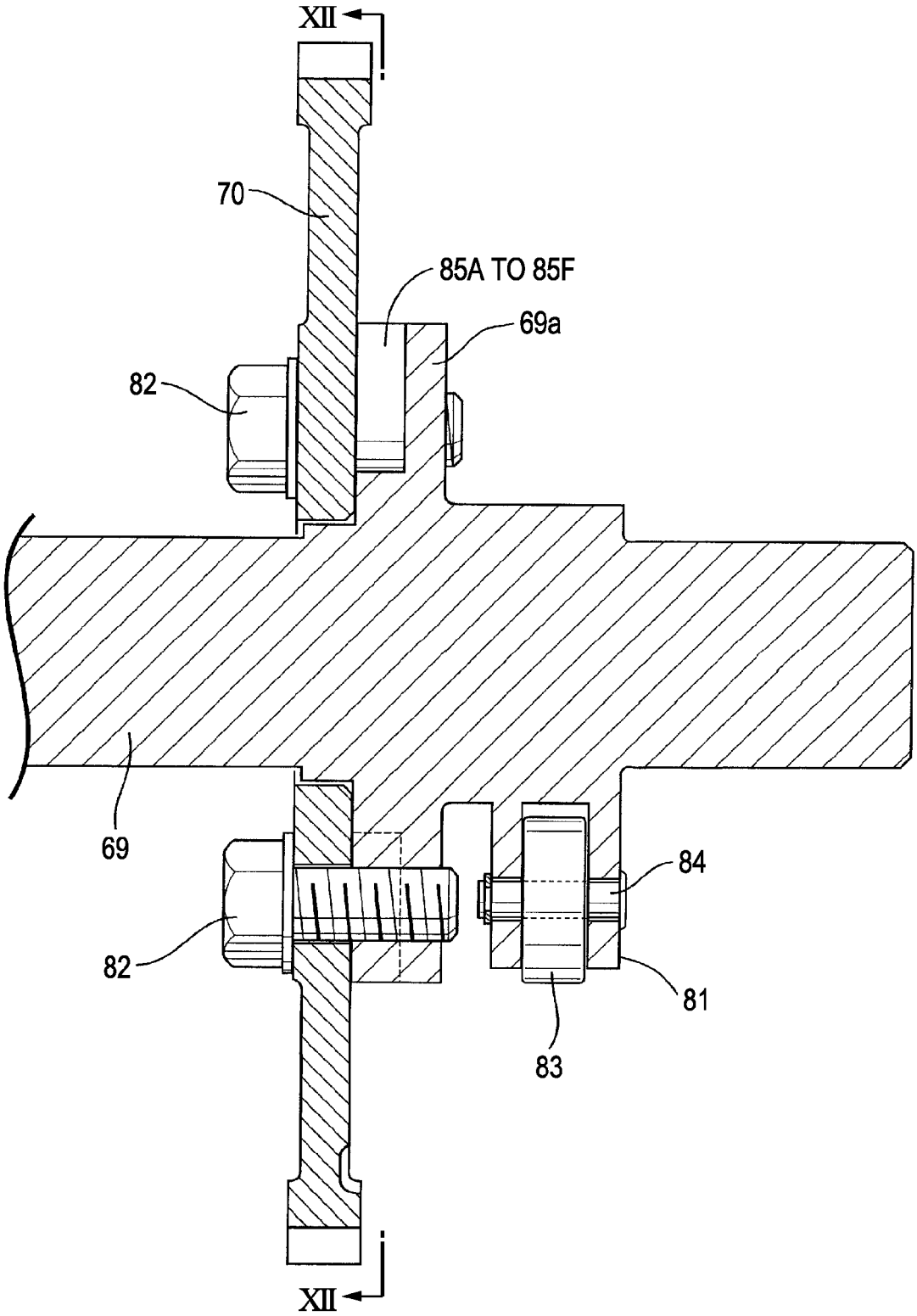
FIG. 10 is a sectional view taken along line X-X in FIG. 9.
Figure 11:
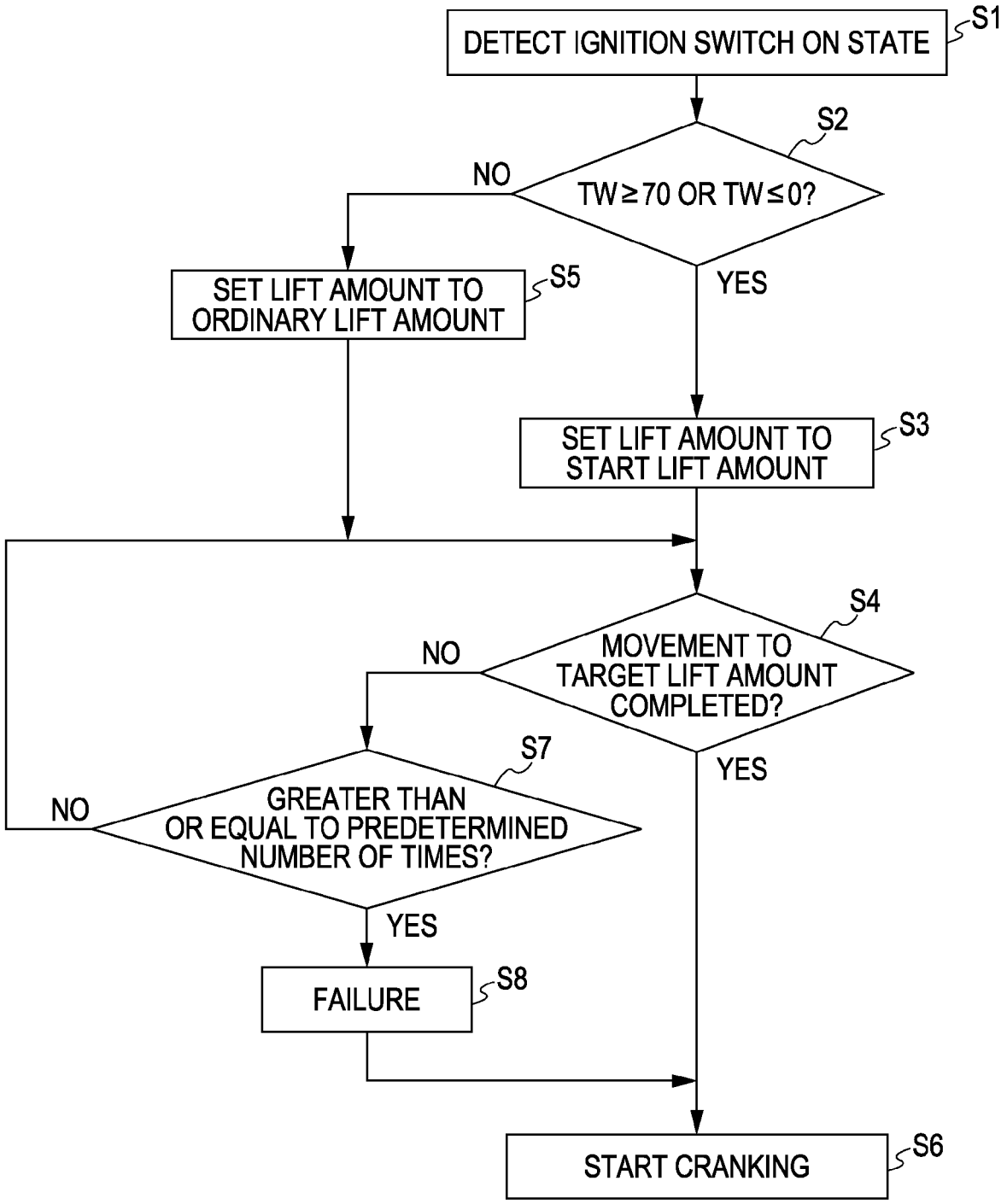
FIG. 11 is a flowchart of a control procedure when the engine is started.

FIGS. 1 to 12 show the embodiment of the present invention. FIG. 1 is a vertical side sectional view of the main portion of an internal combustion engine. FIG. 2 is a sectional view taken along line II-II in FIG. 1. FIG. 3 is an exploded perspective view of the main portion of a variable valve operating device. FIG. 4 is a sectional view taken along line IV-IV in FIG. 2 with a lift amount being high. FIG. 5 is a perspective view of an actuator and a default mechanism. FIG. 6 is a view taken along arrow VI in FIG. 5. FIG. 7 is a sectional view taken along line VII-VII in FIG. 6. FIG. 8 is a sectional view taken along line VIII-VIII in FIG. 6. FIG. 9 is a sectional view taken along line IX-IX in FIG. 6. FIG. 10 is a sectional view taken along line X-X in FIG. 9. FIG. 11 is a flowchart of a control procedure when the engine is started. FIGS. 12A, 12B, and 12C are sectional views taken along line XII-XII in FIG. 10 for illustrating an oil supply operation using oil accumulation portions.

First, in FIGS. 1 to 4, suction valves 16 and 16 (corresponding to a pair of engine valves for one cylinder) are disposed at a cylinder head 15 (constituting a portion of an engine body 14) so that the suction valves 16 and 16 can be opened and closed. A variable valve operating device 17, which drives both suction valves 16 and 16 so that they are opened and closed, includes a cam shaft 19, a pair of sub-cams 21 and 21, locker arms 22 and 22, a control arm 23, and an actuator 24 (see FIG. 5). The cam shaft 19 is provided with valve operating cams 18 individually corresponding to the suction valves 16 and 16. The sub-cams 21 and 21 are swingably supported by a movable support shaft that can be displaced in a plane orthogonal to a rotational axis line of the valve operating cams 18 (that is, an axial line of the cam shaft 19) and swings so as to follow the respective valve operating cams 18. The locker arms 22 and 22 individually move in response to and are individually connected to the respective suction valves 16, and move so as to follow the respective sub-cams 21 and 21. The control arm 23 is connected to the movable support shaft 20, is capable of rotating around an axis line parallel to the axis line of the valve operating cams 18 (that is, the axis line of the cam shaft 19), and holds the movable support shaft 20 at a position that is offset from the rotational axis line thereof. The actuator 24 (see FIG. 5) rotationally drives the control arm 23. By displacing the movable support shaft 20, it is possible to change operation characteristics including lift amounts of the suction valves 16 and 16.

Stems 16*a* and 16*a* of the suction valves 16 are slidably fitted to guide cylinders 25 and 25 disposed at the cylinder head 15. The suction valves 16 and 16 are biased in a valve closing direction by spring force of valve springs 28 and 28 interposed between retainers 27 and 27 that contact the cylinder head 15.

shown in FIG. 2, cam holders 29 and 29 are provided at the cylinder head 15 so as to be disposed, one at one side of its corresponding suction valve 16. Caps 30 and 30, which rotatably support the cam shaft 19 in cooperation with the cam holders 29, are fastened to the top surfaces of the cam holders 29.

One end of each of the locker arms 22 is swingably supported at the control arm 23 through corresponding one of hydraulic tappets 31 and 31. Valve contact portions 22*a* and 22*a*, which contact the top ends of the stems 16*a* and 16*a* of the suction valves 16 and 16, are provided at the other ends of the respective locker arms 22 and 22. First rollers 33 and 33 are supported at intermediate portions of the respective locker arms 22 through needle bearings 32 and 32. These first rollers 33 roll along and contact the sub-cams 21 individually corresponding to the respective locker arms 22.

The control arm 23 is formed by integrally forming side wall portions 23*a* and 23*a*, shaft portions 23*b* and 23*b*, a first connecting wall portion 23*c*, and a second connecting wall portion 23*d* with each other, with an axis line parallel to the cam shaft 19 being a rotational axis line C. The side wall portions 23*a* and 23*a* are disposed one at one side of its corresponding suction valve 16 so as to be spaced apart from each other along the rotational axis line thereof. The shaft portions 23*b* and 23*b* are linked at right angles to the outer surfaces of the side wall portions 23*a* and 23*a*. The first connecting wall portion 23*c* connects the one end of the one side wall portion 23*a* to the one end of the other side wall portion 23*a*. The second connecting wall portion 23*d* connects the other ends of the side wall portions 23*a* and 23*a* to each other. The shaft portions 23*b* and 23*b* are rotatably fitted to supporting holes 34 and 34 formed by the cam holders 29 and 29 and the caps 30 and 30. That is, the control arm 23 is rotatably supported by the cam holders 29 and the caps 30.

The rotational axis line C of the control arm 23, that is, the axis line of the shaft portions 23*b* and 23*b* is disposed above the stems 16*a* and 16*a* of the suction valves 16. When the suction valves 16 and 16 are in a closed-valve seated state, the valve contact portions 22*a* and 22*a*, provided at the other ends of the locker arms 22 and 22, are formed along an arc A (indicated by a phantom line in FIG. 4) having the rotational axis line C of the control arm 23 as center.

Moreover, on a diagram projected onto a plane orthogonal to the rotational axis line C of the control arm 23, the rotational axis line C of the control arm 23 is disposed within a width W between lines extended to above the stems 16*a* and 16*a* (that is, a width between lines shown in FIG. 1).

The movable support shaft 20 having an axis line that is parallel to the cam shaft 19 passes through the sub-cams 21 (disposed inwardly of the respective side wall portions 23*a* of the control arm 23) and a circular cylindrical spacer 35 (interposed between the sub-cams 21). Each end of the movable support shaft 20 contacts an inner side surface of its corresponding side wall portion 23*a*. Bolts 36 and 36, which are inserted into the respective side wall portions 23*a* and 23*a*, are screwed into the respective ends of the movable shaft support 20; and needle bearings 37 and 37 are interposed between the movable shaft support 20 and one of the sub-cams 21 and the movable shaft support 20 and the other sub-cam 21, respectively.

That is, the sub-cams 21 and 21 are rotatably supported at the movable support shaft 20 whose ends are removably mounted to the respective side wall portions of the control arm 23. Moreover, the spacer 35, which is a member provided separately from the movable support shaft 20, is fitted to the outer periphery of the movable support shaft 20 so as to be interposed between the sub-cams 21.

A pair of support arm portions 21*a* and 21*a*, extending towards the second connecting wall portion 23*d* of the control arm 23 between one of the shaft portions 23*b* and the cam shaft 19 and between the other shaft portion 23*b* and the cam shaft 19, respectively, are integrally and consecutively provided with the respective sub-cams 21 so as to have substantially U shapes that are open towards the cam shaft 19. Through needle bearings 39 and 39, second rollers 40 and 40 are supported at support shafts 38 and 38 secured between ends of the support arm portions 21*a* and 21*a*. The second rollers 40 and 40 roll along and contact the valve operating cams 18 at the cam shaft 19. That is, when the second rollers 40 roll along and contact the valve operating cams 18 at the cam shaft 19, the sub-cams 21 and 21 are rotationally driven around the axis line of the movable support shaft 20.

Pressure-receiving arm portions 21*b* and 21*b* are integrally provided with the respective sub-cams 21 at sides opposite to the cam shaft 19 when viewed from the support shafts 38. Spring force that biases the sub-cams 21 so that the second rollers 40 roll along and contact the valve operating cams 18 acts upon the pressure-receiving arm portions 21*b* and 21*b*.

That is, circular cylindrical guide cylinders 43 and 43 having bottoms, having end walls 43*a* and 43*a* at ends opposite to the sub-cams 21 and 21, and extending opposite to the sub-cams 21 and 21 are integrally provided with the second connecting wall portion 23*d* of the control arm 23 individually corresponding to the sub-cams 21. Lost-motion springs 45 and 45 are provided in a compressed manner between contact frames 44 and 44, which contact the pressure-receiving portions 21*b* and 21*b* of the sub-cams 21 and 21, and the end walls 43*a* and 43*a* of the guide cylinders 43 and 43.

Contact surfaces 46 and 46, which the first rollers 33 of the locker arms 22 and 22 roll along and contact the contact surfaces 46 and 46, are provided at the sub-cams 21 and 21. Each contact surface 46 is formed by consecutively forming a lift portion 46*a* (which rotationally drives the corresponding locker arm 22) and a base circular portion 46*b* (whose distances from the axis line of the movable support shaft 20 for holding the locker arms 22 and 22 in a stationary state are equal to each other). Each lift portion 46*a* is formed so as to extend in a straight line so that, when its corresponding sub-cam 21 rotates as its corresponding valve operating cam 18 rotates, the distance between the axial line of the movable support shaft 20 and a point of contact of the lift portion 46*a* with the first roller 33 at the locker arm 22 becomes gradually larger.

In the first connecting wall portion 23*c* of the control arm 23, tappet-mounting cylindrical portions 47 and 47 are integrally provided at portions corresponding to the locker arms 22 and 22. Each tappet-mounting cylindrical portion 47 has an end wall 47*a* at an end opposite to the movable support shaft 20, extends towards a side opposite to the movable support shaft 20, and has a bottom. The hydraulic tappets 31 and 31 are mounted to the respective tappet-mounting cylindrical portions 47 and 47.

Each hydraulic tappet 31 is provided with a circular cylindrical body 48, a plunger 49, a check valve 52, and a return spring 53. The body 48 has a bottom, its closed end is caused to contact its corresponding end wall 47*a*, and is fitted and mounted to the inside of the corresponding tappet-mounting cylindrical portion 47. The plunger 49 is slidably mounted to the body 48. The check valve 52 is inserted between a high-pressure chamber 50 (formed between the closed end of the body 48 and one end of the plunger 49) and a hydraulic chamber 51 (formed in the plunger 49), and is provided at one end of the plunger 49. The return spring 53 applies a spring force that biases the plunger 49 towards a side in which the volume of the high-pressure chamber 50 is increased, and is provided between the body 48 and the plunger 49. One end of each locker arm 22 is swingably supported by a spherical head portion 49*a* at the other end of the plunger 49.

According to the structure of such a variable valve operating device 17, when the control arm 23 is disposed at a position shown in FIG. 4 by the actuator 24, the locker arms 22 are swingably driven by ends opposite to the base circular portions 46*b* of the lift portions 46*a* of the contact surfaces 46 at the sub-cams 21 that rotate around the axis line of the movable support shaft 20. This causes a lift amount h of each suction valve 16 to be a maximum. When the control arm 23 is rotated upward and counterclockwise in FIGS. 1 and 4 by the actuator 24, for example, the first rollers 33 at the locker arms 22 roll along and contact the base circular portions 46*b* of the contact surfaces 46 at the sub-cams 21. In this state, the lift amount h of each suction valve 16 becomes a minimum (=0).

That is, by rotationally driving the control arm 23 by the actuator 24, the lift amount of each of the suction valves 16 and 16 is changed. By changing timings in which the valve operating cams 18 and 18 contact their corresponding second rollers 40 and 40 by rotationally driving the control arm 23, opening/closing timings of the suction valves 16 and 16 are also changed.

A control shaft 69 is coaxially connected to one of the shaft portions 23*b* (see FIGS. 2 and 3) of the control arm 23. By rotationally driving the control shaft 69 by the actuator 24, the control arm 23, formed integrally with the control shaft 69, is rotated.

In FIGS. 5 to 8, the actuator 24 includes a worm wheel 70 and a worm 71. The worm wheel 70 is provided at an end of the control shaft 69, and is disposed in the engine body 14. The worm 71 is disposed at the lower side of the control shaft 69, and engages the worm wheel 70. The worm 71 is provided at a driving shaft 64.

The driving shaft 64 is disposed below the control shaft 69 so as to be orthogonal to the control shaft 69 in plan view. The driving shaft 64 is coaxially connected to an output shaft 62*a* of an electric motor 62 through a coupling 63.

An actuator supporting portion 61, which projects from one end of the cylinder head 15 in a cylinder arrangement direction thereof, is integrally formed with the cylinder head 15 so that a recessed portion 61*a* opens at an upper side thereof. The electric motor 62 is secured to a side wall of the actuator supporting portion 61. A housing 66 is secured to the bottom portion of the actuator supporting portion 61 with bolts 65. The driving shaft 64 is rotatably supported by the housing 66 through needle bearings 67 and ball bearings 68.

In such an actuator 24, when the electric motor 62 is rotationally driven, the control shaft 69 reciprocates and rotates through an angle of, for example, 180 degrees through the output shaft 62*a*, the driving shaft 64, the worm 71, and the worm wheel 70. The lift of each of the suction valves 16 and 16 becomes a maximum (see FIG. 4) at one rotational end (rotational angle of 180 degrees) of the control shaft 69, and the lift of each of the suction valves 16 and 16 becomes a minimum at the other rotational end (rotational angle of 0 degrees) of the control shaft 69.

When a failure occurs in the actuator 24, the valve lifts of the suction valves 16 and 16 are provided by the operation of the default mechanism 60. The default mechanism 60 includes a lever 73, a spring 76, and an arm 81. The lever 73 is swingably supported by a support shaft 72 provided at the housing 66. The spring 76 rotationally biases the lever 73 clockwise in FIG. 7. The arm 81 is provided at the control shaft 69 so that the arm 81 rotates in response to the rotation of the lever 73.

Also with reference to FIG. 9, the support shaft 72 extending parallel to the control shaft 69 is provided at the housing 66. A swing supporting portion 73*a* of the lever 73 is swingably connected to an end of the support shaft 72. The lever 73 has a pressure-receiving portion 73*b* and a pressure-applying portion 73*c*, which are integrally formed with each other. The pressure-receiving portion 73*b* extends in a direction opposite to the electric motor 62 from the swing supporting portion 73*a*. The pressure-applying portion 73*c* extends upward from the swing supporting portion 73*a*.

A vertically extending mounting through hole 66*a* is formed in an end portion of the housing 66 situated opposite to the electric motor 62. An spring accommodating cylinder 74 is inserted into the mounting hole 66*a*, and is secured to the housing 66 with a bolt 75 extending through a bolt hole 74*d* (see FIG. 9) formed in a flange 74*b*. The spring accommodating cylinder 74 has an end wall 74*a* (having a through hole 74*c* at the center thereof) provided at the top end thereof; has a circular cylindrical bottom; and the flange 74*b* provided at the lower end thereof. One lever insertion opening 74*e* and two openings, that is, openings 74*f* and 74*g* are formed in the side wall of the spring accommodating cylinder 74.

The interior of the spring accommodating cylinder 74 accommodates a coil spring 76 and a slider 77. The slider 77 has a guide portion 77*a*, a cutaway portion 77*b*, a spring seat 77*c*, and a nut portion 77*d*. The guide portion 77*a* is slidably guided along the inner peripheral surface of the spring accommodating cylinder 74. The cutaway portion 77*b* is formed in the lower portion of the guide portion 77*a*. The spring seat 77*c* is consecutively provided with the upper portion of the guide portion 77*a*. The nut portion 77*d* is consecutively provided with the upper portion of the spring seat 77*c*. The upper end of the spring 76 is supported by the end wall 74*a* of the spring accommodating cylinder 74 through a spring receiving member 78. The lower end of the spring 76 is supported by the spring seat 77*c* of the slider 77. A roller 80, supported by the slider 77 through a pin 79, is accommodated in the cutaway portion 77*b* of the slider 77. The pressure-receiving portion 73*b* of the lever 73 is inserted into the cutaway portion 77*b* from the lever insertion opening 74*e* of the spring accommodating cylinder 74, and the roller 80 contacts the upper surface of the pressure receiving portion 73*b*.

Therefore, the slider 77 having the guide portion 77*a* that is slidably guided along the inner peripheral surface of the spring accommodating cylinder 74 is biased downward by resilient force of the compressed spring 76. The lever 73 whose pressure-receiving portion 73*b* is pushed downward by the roller 80 is biased clockwise around an axis line of the support shaft 72 in FIG. 9. At this time, the lower surface of the pressure-receiving portion 73*b* of the lever 73 faces a stopper 66*b* (see FIG. 9), provided at the housing 66, so that it can contact the stopper 66*b*. When a limit of clockwise rotation of the lever 73 is restricted as a result of the contact between the pressure receiving portion 73*b* and the stopper 66*b*, the spring 76 and the slider 77 can be held in the spring accommodating cylinder 74 whose lower end is open so as to prevent the spring 76 and the slider 77 from being dislodged from the spring accommodating cylinder 74.

Also with reference to FIG. 10, a flange portion 69*a*, which projects radially outward so as to oppose the side surface of the worm wheel 70, is integrally provided with the control shaft 69. A plurality of locations (such as three locations), which are separated from each other by an equal interval in the peripheral direction of the worm wheel 70, of the worm wheel 70 are fastened to the flange portion 69*a* by bolts 82, 82, and 82.

The arm 81 is integrally formed with the control shaft 69 so as to extend downward from the control shaft 69. A roller 83, which can roll along and contact the pressure-applying portion 73*c* of the lever 73, is rotatably supported by an end of the arm 81 through a pin 84.

According to such a default mechanism 60, when a lift amount of the variable valve operating device 17 is high, the control shaft 69, formed consecutively with the control arm 23, is stopped at a counterclockwise limit rotational position (rotational angle of 180 degrees). At this time, the pressure receiving portion 73*b* of the lever 73 contacts and is stopped by the stopper 66*b* by resilient force of the spring 76, and the pressure-applying portion 73*c* of the lever 73 is separated from the roller 83 at the end of the arm 81 at the control shaft 69.

When the control shaft 69 whose lift amount is high is rotated to a clockwise limit rotational position (rotational angle of 0 degrees) and the lift amount of the variable valve operating device 17 is set low, the roller 83 at the end of the arm 81 at the control shaft 69 rotating clockwise pushes the pressure-applying portion 73*c* of the lever 73, so that the lever 73 swings around the supporting shaft 72 as center, and the pressure-receiving portion 73*b* thereof pushes the slider 77 upward and compresses the spring 76.

When, in this state, a failure occurs in the actuator 24, the lift amounts of the suction valves 16 are fixed to low amounts (that is, zero), thereby preventing the internal combustion engine from starting or operating. However, even if a failure occurs in the actuator 24, the lever 73 is rotated clockwise by a predetermined amount by pushing down the pressure-receiving portion 73*b* of the lever 73 by the compressed spring 76 through the slider 77. As a result, the arm 81 at which the roller 83 is pushed by the pressure-applying portion 73*c* of the lever 73 causes the control shaft 69 to rotate counterclockwise by a predetermined angle (17 degrees in the embodiment), so that required lift amounts that are greater than zero are provided for the valve lift amounts of the suction valves 16. Therefore, it is possible to start and operate the internal combustion engine.

Even if the operation of the electric motor 62 is stopped when the engine is stopped, the control shaft 69 is rotated to the clockwise limit rotational position so that the lift amount of the variable valve operating device 17 is set low. By the operation of the default mechanism 60, the rotational position of the control shaft 69 is kept at a rotational position that is the same as that when a failure occurs in the actuator 24.

Of the actuator 24 and the default mechanism 60, having such structures, portions excluding the electric motor 62 are accommodated in the internal portion of the engine body 14, that is, in a space between a head cover 85 and the actuator supporting portion 61 at the end of the cylinder head 15 in the embodiment.

The engine is started by cranking after operating the electric motor 62 at the actuator 24 so that the lift amounts of the suction valves 16 and 16 are equal to a start lift amount (such as 10 mm). As shown in FIG. 11, after detecting an on state of an ignition switch in Step S1, then, in Step S2, it is confirmed whether or not a cooling water temperature TW of the engine is greater than or equal to 70° C. or less than or equal to 0° C. If the cooling water temperature TW of the engine is greater than or equal to 70° C. or is less than or equal to 0° C., the lift amounts of the suction valves 16 and 16 are set to the start lift amount (such as 10 mm) in Step S3. Then, the process proceeds to Step S4. If, in Step S2, it is confirmed that the cooling water temperature TW of the engine is 0° C.<TW<70° C., the lift amounts of the suction valves 16 are set to ordinary lift amounts in Step S5, after which the process proceeds to Step S4.

In Step S4, it is confirmed whether or not the lift amounts of the suction valves 16 have reached target lift amounts set in Step S3 or Step S5. If it is confirmed that that they have reached the target lift amounts, cranking is started in Step S6. If it is confirmed that they have not reached the target lift amounts, the process proceeds from Step S4 to Step S7. In Step S7, it is confirmed whether or not the number of times of confirmations that the lift amounts have not reached the target lift amounts is greater than or equal to a predetermined number of times. If it is less than the predetermined number of times, the process returns to Step S4. In contrast, if it is greater than or equal to the predetermined number of times, it is determined that a failure has occurred in Step S8.

As clearly shown in FIG. 8, a plurality of oil accumulation portions (such as six oil accumulation portions) 85A, 85B, 85C, 85D, 85E, and 85F are formed in at least one of the control shaft 69 and the worm wheel 70, that is, between the flange portion 69*a* of the control shaft 60 and the worm wheel 70. These oil accumulation portions 85A to 85F are formed by the worm wheel 70 and arc-shaped recesses 86 provided in the surface of the outer peripheral portion of the flange portion 69*a* facing the worm wheel 70. Two oil accumulation portions each are disposed between the three bolts 82, 82, and 82 used for fastening the worm wheel 70 to the flange portion 69*a*. Accordingly, a total of six oil accumulation portions 85A, 85B, 85C, 85D, 85E, and 85F are disposed so as to be arranged side by side in that order in the peripheral direction. A cutaway portion 87 for determining a peripheral-direction relative position of the worm wheel 70 with respect to the control shaft 69 is provided in the worm wheel 70 so as to be positioned outwardly of the oil accumulation portion 85B.

Figure 12A:
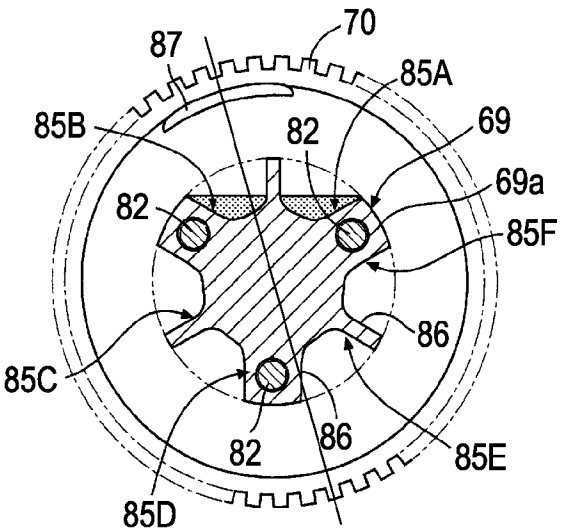
FIGS. 12A, 12B, and 12C are sectional views taken along line XII-XII in FIG. 10 for illustrating an oil supply operation using oil accumulation portions.
Figure 12B:
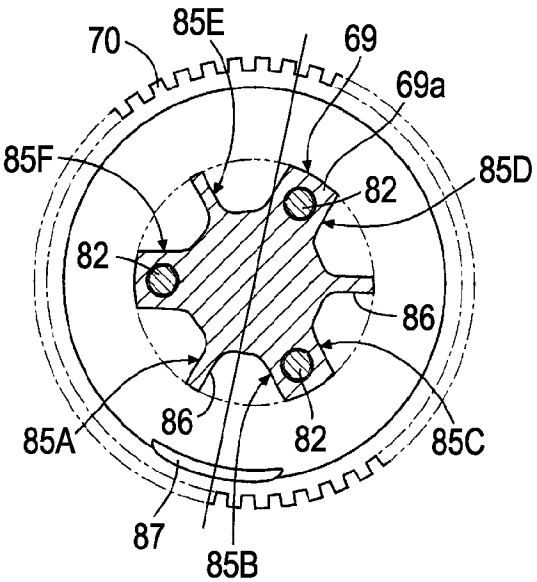
Figure 12C:
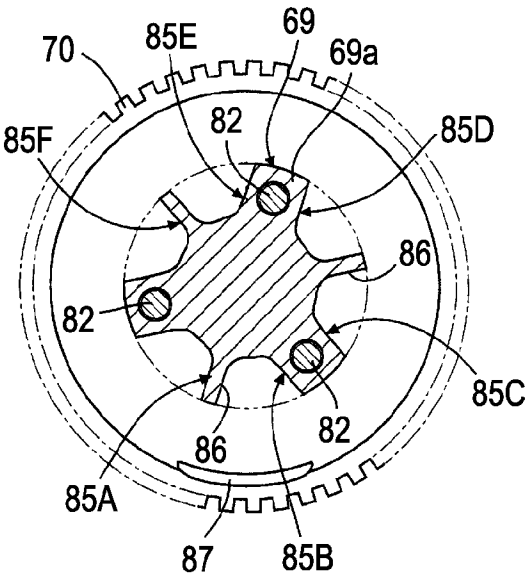

Accordingly, when the engine is stopped, as shown in FIG. 12A, the oil accumulation portions 85A and 85B exist at the upper positions. When the control shaft 69 and the worm wheel 70 are rotated so that the lift amounts of the suction valves 16 are the start lift amount (such as 10 mm) when the engine is started, the oil accumulation portion 85B exists at the lower position as shown in FIG. 12B. Further, when the lift amounts of the suction valves 16 are a maximum lift amount, as shown in FIG. 12C, the control shaft 69 and the worm wheel 70 are rotated slightly from the state shown in FIG. 12B in which the oil accumulation portion 85B remains at the lower position.

Since the oil accumulation portions 85A to 85F are formed between the control shaft 69 and the worm wheel 70 so as to be open outward in the radial direction of the control shaft 69 and the worm wheel 70 disposed in the engine body 14, any oil accumulation portion disposed at the upper position among the oil accumulation portions 85A to 85F can accumulate oil that has flown in the engine body 14. Since the oil accumulation portion 85B is disposed at its upwardly facing position when the engine is stopped, and is at the lower position when the lift amounts of the suction valves 16 are the start lift amount when the engine is started, it is possible to drop oil to the worm 71 disposed at the lower portion of the worm wheel 70 in accordance with the rotation of the control shaft 69 when the engine is started.

Next, the operation according to the embodiment will be described. The control shaft 69, which changes operation characteristics including the lift amounts of the suction valves 16, is rotationally driven by the actuator 24. The six oil accumulation portions 85A, 85B, 85C, 85D, 85E, and 85F are formed at at least one of the control shaft 69 and the worm wheel 70 (provided at the control shaft 69 so as to constitute a portion of the actuator 24 and disposed in the engine body 14), that is, between the flange portion 69*a* of the control shaft 60 and the worm wheel 70 in this embodiment. Of the oil accumulation portions 85A to 85F, the oil accumulation portion 85B is disposed at the lower portion of the worm wheel 70 in accordance with the rotation of the control shaft 69 when the engine is started, so that it is possible to drop oil onto the worm 71 that engages the worm wheel 70.

Therefore, oil accumulated in the oil accumulation portion 85F is dropped onto the worm 71 in accordance with the rotation of the control shaft 69 when the engine is started. Therefore, it is possible to prevent the actuator from being insufficiently lubricated, to restrict the generation of operating noise, and to restrict the occurrence of wear. In particular, it is possible to restrict the generation of operating noise and the occurrence of serious wearing of only a particular portion when there is a lack of lubricating oil immediately after starting the engine.

When the lift amounts of the suction valves 16 are the start lift amount, the oil accumulation portion 85B is disposed at the lower position. Therefore, it is possible to reliably supply oil so that the oil in the oil accumulation portion 85B is reliably dropped towards the worm 71. Moreover, since the oil accumulation portion 85B faces upward when the engine is stopped, it is possible to reliably accumulate the oil in the oil accumulation portion 85B when the engine is stopped.

Since the control shaft 69 and the worm wheel 70 are rotationally driven by the default mechanism 60 so that the oil accumulation portion 85B faces upward when the engine is stopped, oil can be reliably accumulated in the oil accumulation portion 85B by causing the oil accumulation portion 85B to face upward by the operation of the default mechanism 60.

An embodiment of the present invention provides an internal combustion engine in which an actuator is not insufficiently lubricated when operating the actuator so that a lift amount of an engine value becomes equal to a start lift amount when the engine is started.

Accordingly, according to an embodiment of the present invention, there is provided an internal combustion engine including a control shaft that causes a lift amount of an engine valve to be varied in accordance with a rotational position thereof, and an actuator that rotationally drives the control shaft. The engine is started after operating the actuator so that the lift amount of the engine valve becomes a start lift amount when the engine is started. The actuator includes a worm wheel and a worm. The worm wheel is provided at the control shaft and is disposed in an engine body. The worm is disposed below the control shaft and engages the worm wheel. An oil accumulation portion is provided at at least one of the control shaft and the worm wheel. The oil accumulation portion makes it possible to drop oil onto the worm in accordance with the rotation of the control shaft when the engine is started.

According to the embodiment of the present invention, oil accumulated in the oil accumulation portion, provided at at least one of the control shaft and the worm wheel, is dropped onto the worm in accordance with the rotation of the control shaft when the engine is started. Therefore, it is possible to prevent the actuator from being insufficiently lubricated, to restrict the generation of operating noise, and to restrict the occurrence of wear. In particular, it is possible to restrict the generation of operating noise and the occurrence of serious wear of only a particular portion when there is a lack of lubricating oil immediately after starting the engine.

The oil accumulation portion may be disposed at at least one of the control shaft and the worm wheel so that the oil accumulation portion is disposed at a lower position when the lift amount of the engine valve becomes the start lift amount.

In this case, it is possible to reliably supply oil so that oil in the oil accumulation portion is reliably dropped towards the worm when the lift amount of the engine valve becomes the start lift amount.

The oil accumulation portion, which makes it possible to drop the oil onto the worm in accordance with the rotation of the control shaft when the engine is started, may be disposed at at least one of the control shaft and the worm wheel so that the oil accumulation portion faces upward when the engine is stopped.

In this case, the oil accumulation portion, used to drop oil towards the worm when the lift amount of the engine valve becomes the start lift amount, faces upward when the engine is stopped. Therefore, it is possible to reliably accumulate oil in the oil accumulation portion when the engine is stopped.

The internal combustion engine may further include a default mechanism that rotationally drives the control shaft and the worm wheel so that the oil accumulation portion faces upward when the engine is stopped.

In this case, the oil accumulation portion is faced upward by the operation of the default mechanism when the engine is stopped, so that it is possible to reliably accumulate oil in the oil accumulation portion.

Although the embodiment according to the present invention is described, the present invention is not limited to the above-described embodiment. Various modifications in design can be made without departing from the gist of the present invention as discussed in the claims.

The present invention can be carried out in relation to, for example, an exhaust valve.

What is claimed as new and is desired to be secured by Letters Patent of the United States is:

1. An internal combustion engine comprising:

a control shaft configured to vary a lift amount of an engine valve in accordance with a rotational position of the control shaft;

an actuator configured to rotationally drive the control shaft according to an engine running state, the actuator being configured to drive the control shaft to make the lift amount of the engine valve to be a start lift amount before the engine is started, the actuator comprising:

a worm wheel provided at the control shaft and disposed in an engine body; and a worm disposed below the control shaft and engaging with the worm wheel; and an oil accumulation portion provided at at least one of the control shaft and the worm wheel and configured to drop oil onto the worm in accordance with the rotation of the control shaft when the engine is started.

2. The internal combustion engine according to claim 1, wherein the oil accumulation portion is disposed at at least one of the control shaft and the worm wheel so that the oil accumulation portion is positioned at a lower position when the lift amount of the engine valve is made to be the start lift amount.

3. The internal combustion engine according to claim 2, wherein the oil accumulation portion is disposed at at least one of the control shaft and the worm wheel so that the oil accumulation portion faces upward when the engine is stopped.

4. The internal combustion engine according to claim 1, further comprising:

a default mechanism configured to rotationally drive the control shaft and the worm wheel so that the oil accumulation portion faces upward when the engine is stopped.

5. The internal combustion engine according to claim 1, wherein the engine body has an actuator supporting portion which projects from an end portion of the engine body in a cylinder arrangement direction, wherein a driving source of the actuator is provided at a side wall of the actuator supporting portion, and wherein a driving shaft of the actuator having the worm is arranged in the actuator supporting portion.

6. An internal combustion engine comprising:

rotating means for varying a lift amount of an engine valve in accordance with a rotational position of the rotating means;

actuating means for rotationally driving the rotating means according to an engine running state, the actuating means driving the rotating means to make the lift amount of the engine valve to be a start lift amount before the engine is started, the actuating means comprising:

first engaging means for engaging with the rotating means and disposed in an engine body; and second engaging means disposed below the rotating means and for engaging with the first engaging means; and oil accumulating means provided at at least one of the rotating means and the first engaging means and for dropping oil onto the second engaging means in accordance with the rotation of the rotating means when the engine is started.

* * * * *